US009683360B1

(12) United States Patent
Vigoa

(10) Patent No.: US 9,683,360 B1
(45) Date of Patent: Jun. 20, 2017

(54) AUTOMATED PIPE CLEARER

(71) Applicant: Daisval Vigoa, Hialeah, FL (US)

(72) Inventor: Daisval Vigoa, Hialeah, FL (US)

( * ) Notice: Subject to any disclaimer, the term of this patent is extended or adjusted under 35 U.S.C. 154(b) by 0 days.

(21) Appl. No.: 15/441,151

(22) Filed: Feb. 23, 2017

(51) Int. Cl.

| | |
|---|---|
| ***B08B 9/027*** | (2006.01) |
| ***B08B 9/045*** | (2006.01) |
| ***B08B 9/047*** | (2006.01) |
| ***E03F 9/00*** | (2006.01) |
| ***B65H 75/44*** | (2006.01) |

(52) U.S. Cl.
CPC ..... *E03F 9/005* (2013.01); *B08B 9/027* (2013.01); *B08B 9/045* (2013.01); *B08B 9/047* (2013.01); *B65H 75/446* (2013.01); *B65H 75/4471* (2013.01); *B65H 75/4481* (2013.01)

(58) Field of Classification Search
CPC ..... B08B 9/027; B08B 9/045; B08B 9/047; E03F 9/005
See application file for complete search history.

(56) References Cited

U.S. PATENT DOCUMENTS

| | | | | |
|---|---|---|---|---|
| 2,625,699 | A * | 1/1953 | Jurasevich | E03F 9/005 15/104.33 |
| 4,520,524 | A | 6/1985 | Long | |
| 5,226,207 | A | 7/1993 | Elzuardia | |
| 5,901,401 | A * | 5/1999 | Rutkowski | B08B 9/045 15/104.31 |
| 8,931,131 | B1 | 1/2015 | Feduke | |
| 2002/0102136 | A1 | 8/2002 | Holland | |
| 2009/0292502 | A1 * | 11/2009 | Gress | B08B 9/045 702/163 |

FOREIGN PATENT DOCUMENTS

| | | |
|---|---|---|
| CA | 2472609 | 6/2004 |
| WO | WO 0268134 | 2/2002 |

* cited by examiner

*Primary Examiner* — Randall Chin
(74) *Attorney, Agent, or Firm* — Christopher J. Vandam, PA; Chris Vandam

(57) ABSTRACT

An automated pipe clearer that is permanently mounted to a building. The pipe clearer has a spool of cable that extends a head assembly down a pipe. The sealed head assembly contains a motor and has a tip at a forward end. A computer control actuates a feeder to extend the cable and connected head assembly down a pipe towards a clog. When the clog is cleared the feeder re-spools the cable leaving the head assembly in the pipe ready for the next clearing operation.

5 Claims, 3 Drawing Sheets

AUTOMATED PIPE CLEARER

BACKGROUND OF THE INVENTION

1. Field of the Invention

The present invention relates to plumbing, and more particularly, to a device and method for automated clearing of clogs in drain pipe.

2. Description of the Related Art

Several designs for drain clearers have been designed in the past. None of them, however, includes a built in appliance that will clear a pipe when the pipe clogs without needing human intervention beyond initiating the automated process.

Applicant believes that the closest reference corresponds to U.S. Pat. No. 5,226,207 issued to Elzaurdia. However, it differs from the present invention because, although Elzaurdia includes a motorized head, it is not permanently mounted within the structure and does not have an automated computer controlled means to extend the head a specific distance into the clogged pipe and withdraw back into the wall when the clog is cleared without further human intervention.

Other patents, such as U.S. Pat. No. 8,931,131 issued to Feduke, disclose a variety of powered snakes. Each of these designs require a plumber or other technician to bring a machine to the pipe, open an access to the clogged pipe, insert a tool into the pipe, the technician operates the machine and then removes the machine from the premises. None of the machines are permanently affixed to the structure and all require substantial human intervention.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a rapid and effective solution to a clogged drain pipe.

It is another object of this invention to provide a method and device that does not require substantial technical know-how to use to clean drain pipes.

It is still another object of the present invention to provide a convenient automated pipe clearing device and method of use to reduce the burden on property managers as well as occupants in the event of plumbing clogs.

It is yet another object of this invention to provide such a device and method of use that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
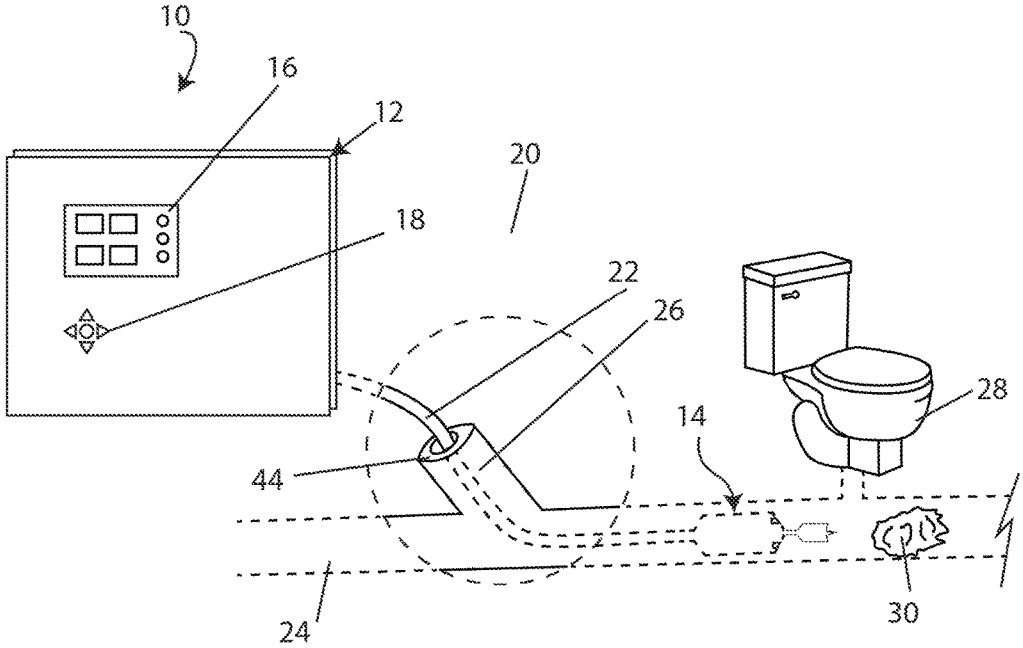
FIG. 1 shows a perspective view with partial cross-section of an example of the device in use clearing a clog.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the automated/automatic pipe cleaner/clearer, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Plumbing clogs and associated repairs cost businesses not only in direct cost of hiring plumbing professionals to repair the problems but also in the comfort and safety of their customers. From first recognizing a problem and calling a plumber until the plumber arrives to diagnose and solve the problem with drains can take hours, if not more. Emergency or rush charges can escalate the costs. Meanwhile, employees and customers become frustrated at the lack of functioning bathroom facilities or other drain-critical infrastructure.

When a repair of a clog is begun by plumbers the business can also be disrupted. Pipe clearing equipment is not sanitary and is not normally exposed to customers or employees. Overall, a plumbing stoppage can stop all work and cost the business substantially above and beyond the actual repair.

Similar issues can happen in a residential setting, whether single family or multi-unit structures. Plumbing drainage is a critical piece of building infrastructure that no one considers until it is no longer functioning. Then is the most critical system for enjoyable and safe occupancy.

Prior art solutions have been to call a plumber and hope they are available for a rapid repair. This is expensive and takes time that can cause consternation for the occupants. Other self-help solutions for the home owner or building maintenance or staff is often under powered, unavailable and coupled with use by untrained staff is not always a viable solution in many scenarios.

A solution that can be utilized by anyone, plumber or not, and on a moment's notice would prevent aggravation and related issues. Generally, a permanently mounted and connected device that is preset to clear the length of customer owned pipe up to the main with a press of a button would quickly and cleanly solve the problem clog and return the premises to normalcy is needed.

The drawings are representative of the general features of an automated pipe clearer. Some alternatives are shown that can be implemented to be effective as context and use requires. Some aspects of the drawings are stylized to emphasize characteristics of assemblies and sub-assemblies to more clearly discuss the important and optional parts but not all are required as can be readily assessed from the discussion and drawings.

Referring now to the drawings, where the present invention is generally referred to with numeral 10, it can be observed that it basically includes a case assembly 12, a head assembly 14, a display 16, a control 18, a wall 20, a cable 22, a pipe 24, a fitting 26, a toilet 28, a clog 30, a head 32, a motor 34, a shaft 36, a tip 38, a camera 40, a light 42, a cap 44, a wire 46, a computer 48, a feeder wheel 50, a spool 52, a coil 54, a motor 56, a coil 58 and a base 60.

The primary mechanicals of the automated pipe clearer are contained inside the case assembly 12. Typically the case assembly 12 is a box to protect and contain the several parts of the device. It is preferred to locate the case assembly 12 at a point as high or higher in the gravity drain system than where any potential blockage or clog 30 could present.

Figure 6:
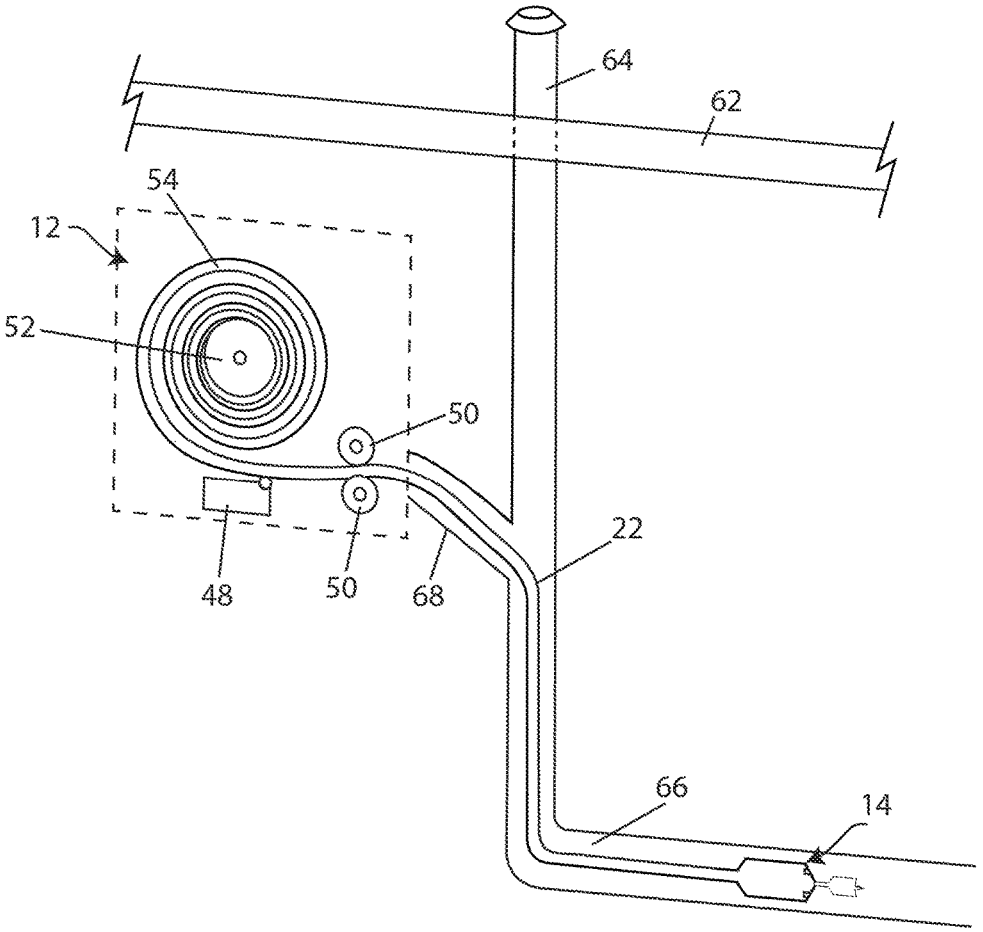
FIG. 6 is an elevation view of an example of a pipe clearer as might be installed in a structure.

The case assembly 12 can be mounted separate from the controls 18 and/or display 16. This allows the case assembly 12 and primary components contained therein to be in an ideal location for the pipes 24 while the controls 18 and display 16 can be in a convenient location for easier use. For example, the controls 18 and display 16 might be in a mechanicals room and the case assembly 12 in the attic accessing a vent stack, similar to that seen in FIG. 6.

Depending on the length of the run between the high side of the drain pipe and the municipal main sewage line or septic tank, there may be more than one automated pipe cleaner used in series. If more than one system is installed in a structure they may be data linked to work in sequence so as to not interfere with each other. In such a multiple unit deployment the lower-most device is typically first operated through its work cycle and then sequentially units up-line then go through the complete clearing cycle to complete the clearing process.

For most residential and many business or industrial applications of the device one unit will suffice. The case assembly 12 may be affixed to the structure near the high side of the drain pipe 24 at a cleanout fitting 26 or other opening to access the interior of the pipe 24. A cap 44 may also be provided at the fitting 26 to permit easy passage of the cable 22 into and out of the pipe 24 while preventing sewer gasses from escaping through the fitting 26.

The case assembly 12 should also have access to a permanently connected power supply so that it is always ready for immediate use. Power is needed to use the computer 48 and power the motors 56. In most cases standard voltage is sufficient for most residential application. However, for larger scaled up versions for larger structures such as factories, airports, multi-unit dwelling structures, more power may be needed to adequately power the device.

The exterior of the case assembly 12 is shown in FIG. 1. Typically, the case assembly 12 will be affixed into or onto a wall 20 where it can be accessed by authorized personnel. Particularly, the display 16, if present, and controls 18 should be accessible for use. The controls 18 may be protected to deter unauthorized activation of the device to prevent damage.

Figure 3:
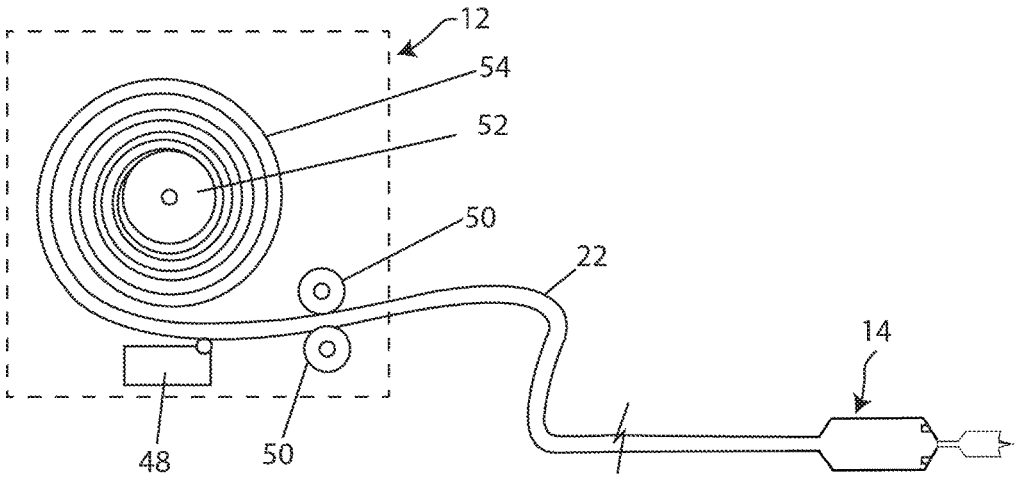
FIG. 3 shows an elevation view of the major assemblies comprising the device.
Figure 4:
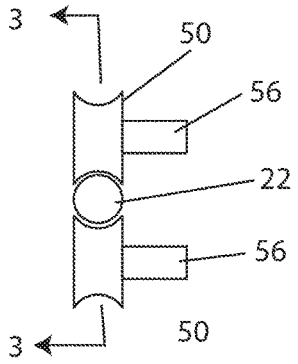
FIG. 4 is shows a side elevation detail of the feeding mechanism shown in FIG. 3.

Inside the case assembly 12, shown in FIG. 3, are contained the spool 52 that neatly holds the coil 54 of cable 22 when the device is at rest and ready for use. A computer 48 that controls the system may also be conveniently protected inside the case assembly 12. The case assembly 12 may be locked to prevent unauthorized access.

The computer 48 may be operatively connected to a sensor that reads the revolutions per minute (RPM) or electrical load of the motor 34. This can help the computer 48 determine whether the motor 34 is getting bogged down in a clog 30. If such a condition occurs the motor 34 is susceptible to overload and ultimately failure. If an overload or jam is detected then the computer 48 can stop the motor 34 and retract the head assembly 14 to clear the clog 30 then restart the motor 34 and press back into the clog 30. Within one or several retractions and pushes on the clog should break and the head assembly 14 can continue to clear the rest of the pipe 24.

Affixed to the end of the cable 22 is the head assembly 14. While the device is at rest the head assembly 14 is retracted from interfering with drainage, typically into the upper end of the fitting 26 or otherwise above any branches of the drain pipe 24.

Figure 2:
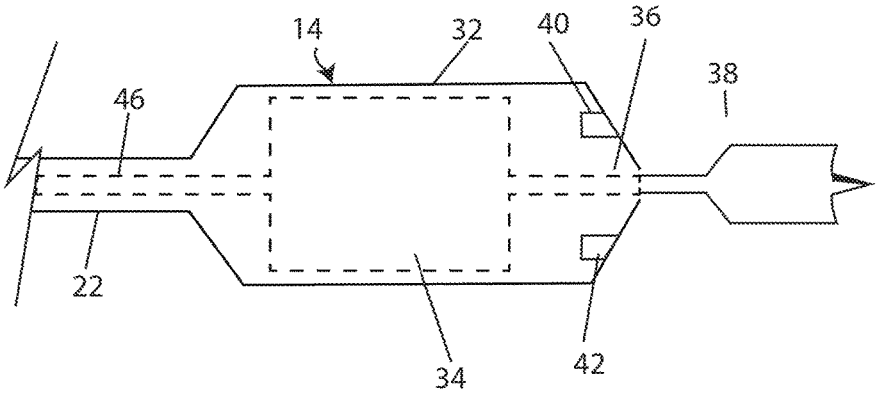
FIG. 2 shows an elevation view of an example of a head assembly with broken lines showing some internal structure.

FIG. 2 shows a detail of an example of a head assembly. On one end of the head assembly 14 is connected to the cable 22 leading back to the case assembly 12 where the cable 22 is wrapped about the spool 52. The other end of the head assembly 14 terminates in tip 38.

Inside the cable 22 is a wire that is used to provide power to the motor 34 inside the head assembly 14. The head assembly 14 may optionally also contain a forward facing camera 40 and light 42. The cable 22, in this optional version, could also carry video signal fees and power for the camera for observation on the display 16 of the case assembly 12 or transmitted to another location where the contents of the pipe 24 may be observed.

The primary purpose of the head assembly 14 is to contain the motor 34 in a waterproof environment to protect the motor 34 from the corroding contents of the pipe 24. Similarly, if present, the camera 40 and light 42 would also be protected. The shaft 36 passes through the head 32 and is connected to the tip 38. In operation, the motor 34 spins the shaft 36 and tip 38 as the feeder wheels 50 push the cable 22 down the pipe 24 and into the clog 30.

The spinning bit 38 strikes and breaks up the clog 30 so that the clog 30 can be flushed free and the pipe's 24 ability to normally drain is restored. In many cases the backed up sewage water above the clog 30 will be sufficient to flush the broken up pieces of clog 30 towards the sewer main. In some cases some additional flushing water above the clog 30 may be needed during or immediately after the spinning tip 38 breaks up the clog 30.

By having the motor 34 in the head assembly 14 only the tip 38 spins. This is in contrast to many prior art "snakes" where the whole cable is spun from outside the pipe being cleared. It is important that the head assembly be dimensioned and adapted to fit inside commonly found pipes and also be able to navigate the turns and bends in the pipe to ensure that it can travel the full length needed to completely clear the pipe of possible clogs or other obstructions.

The characteristics of the cable 22 are also important so that the cable 22 is stiff enough to be pushed through the pipe 24 by the feeder wheels 50 and yet be flexible enough to accommodate being pushed through bends, fitting and joints without binding or causing undue friction on either the interior of the pipe 24 or the cable 22. To aid in the ability for the head assembly 14 to be able to pass through tight radii there may be a flexible joint between the end of the cable 22 and where the cable 22 enters the head 32.

The shape of the head 32 may also be used to stabilize the head assembly 14 inside the pipe 24. The length of the head 32 may be designed to be complimentary to the diameter of the pipe 24 and any fittings 26 so that the head assembly 14 can pass through all parts of the pipe 24 easily and not get sideways or buckled in the pipe 24. To the same end the head 32 may also include stabilizers in front or behind the head assembly 14 to keep the head assembly 14 leveled and pointed down the center of the pipe 24 where the tip 38 is most effective against any clogs 30 that it may encounter. The stabilizers can also help the head assembly 14 navigate turns in the pipe 24 or fittings 26 and to avoid the head assembly 14 from getting crooked in the pipe 24.

The cable 22 may be constructed of metal and plastic components. The cable 22 may shield the wire 46 inside the cable 22 to prevent it from being abraded and extending its service life. The cable 22 may be sheathed in a durable or friction reducing compound to allow free passage through the pipe and protect the wire 46 inside.

In one version of the device the computer 48 is calibrated to measure the length of cable 22 that has been inserted into the pipe 24 from the spool 52. The installer of the automated pipe clearer may ensure that the computer 48 can feed the cable 22 out far enough to reach the entire length of the pipe 24 up to the main sewer. Similarly, if there are multiple devices along a longer length of pipe the length the cable 22 is permitted to extend is set to avoid one clearer to interfere with other clearers down the line in series.

By being able to set the length of extension at the computer instead of changing the length of the cable 22 for each application site a one-size-fits-most coil 54 of cable 22 can be more economically fabricated. For example, coils 54 could be made available in fifty feet, a hundred feet and two hundred feet. Of course, other lengths may be made but these sizes will apply to most situations.

The computer 48 may also be preset to extend the head assembly 14 a distance into the pipe 24 to clear a fitting 26 or to transition from a vertical vent stack into the main drain pipe 24 before powering up the motor 34. This can protect the parts of the pipes that are unlikely to clog or are tricky to navigate. Once the head assembly 14 is clear of complications in the pipe 24 then the motor 34 may be activated.

Figure 5:
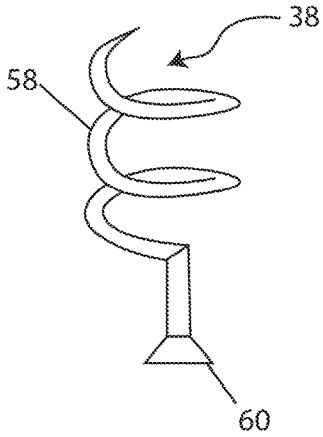
FIG. 5 is a perspective view of an alternate tip.

FIG. 5 shows an alternate tip 38 that can be attached to the shaft 36 at the front of the head assembly 14. There could be numerous effective geometries of tips. In the example in this figure a coil 58 is demonstrated. The base 60 of the coil 58 may be adapted to be interchangeable to the front end of the shaft 36 or may be permanently attached to the shaft 36 as supplied from the factory.

Other tips may be configured to not hook onto or catch the clog. Instead, it may be preferred to have a spade shaped bit or other grinder tip that can attack a clog to break it up without drawing the clog onto the bit or tip. This can help reduce the possibility of clogging or otherwise impeding the performance of the tip 38.

If a design such as the coil 58 in FIG. 8 is used then the computer 48 may be programmed to turn the coil 58 selectively in both a clockwise and counterclockwise directions. This can allow this style of tip 38 to essentially screw into a clog 30, pull it apart by grinding or piercing into it and then retracting the cable 22. The spin direction of the tip can be reversed to unscrew the now broken up clog 30 from the tip 38 so that the parts of the clog 30 may be flushed out of the pipe 24 into the municipal sewer main, permanently solving that clog 30.

A typical use of the automated pipe clearer begins when a clog occurs in a pipe. A sink might backup or a toilet may overflow. An authorized user of the clearer accesses the controls 18 at the case assembly 12 (or remotely connecting to the computer 48 in the case assembly 12) to initiate the clearing process. The motors 56 driving the feeder wheels 50 grip the cable 22 thereby extending the head assembly 14 attached to the end of the cable 22 down the pipe 24.

The tip 38 may be set to continually spin or only spin when the computer 48 senses resistance experienced by the feeder wheels 50 that indicates that the clog 30 has been reached. Essentially, in this option, only when the clog is sensed to be hit by the extending cable 22 the tip 38 spins. This can save unnecessary wear and tear from the spinning tip 38 in the pipe 24 where there is no clog 30.

Continuing the example of use, the head assembly 14 is pushed at the front of the cable 22 by the feeder wheels 50 throughout a predetermined length of pipe 24. Since every plumbing design is different, the initial installer of the clearer may set the computer to extend the cable 22 the specific length need to clear the entire length of pipe 24 without going too far and pushing the head assembly 14 into the municipal or septic drain systems. This keeps the head assembly 14 only where clogs are possible and without interfering with elements of the plumbing system not controlled by the building owner.

The computer 48 may be programmed to peck at a clog 30 when it senses the tip 38 has reached the clog 30. With this feature the spinning tip 38 is pushed into the clog 30 and retracted repeatedly to break up the clog 30. When resistance is no longer sensed by the computer 48 the clog is determined to be at least partially broken. Then the head assembly 14 can be pushed all the way to it preprogrammed length or retracted to return the device to a ready and waiting state.

If the camera 40 and light 42 options are included in the head assembly 14 then the display 16 can show the operator the nature of the clog 30 or if there may be other issues causing the drain backup, such as a broken pipe. The display 16 can also show system status, allow for adjusting settings or modes, the maximum length to extend the cable 22 or any other feature of the device. For example, if a broken pipe is detected the computer 48 can provide the distance from the case assembly 12 to accurately determine the precise location of the break so minimal floor damage is required for replacing the pipe.

The case assembly 12 may also include a drain that feeds back into the fitting 26 to allow water dripping from a retracted cable 22 onto the spool 52. Vent holes in the case assembly 12 can also help reduce corrosion from moisture carried by the cable 22 into the case assembly 12 during the retraction process.

Another version of the device is intended to be connected to a vent stack instead of the drain. The features and operations are similar for either application of the device.

A version of the invention can be fairly described as an automated pipe clearing device comprising, among other features, a case assembly and a head assembly. The case assembly contains, among other things, a reel, a cable, a computer and a feeder. The head assembly includes a motor. The head assembly on a first end is connected to a first end of the cable. The head assembly on a second end has a rotatable bit operatively connected to the motor. A second end of the cable is in electrical communication with the computer or controller. The cable includes a wire to supply electrical power to the motor in the head assembly. The feeder is controlled by the computer and selectively spools and unspools the cable from around the reel. The case assembly is permanently mounted at a high side of a pipe. The head assembly permanently remains inside the pipe. In a rest mode the cable is spooled around the reel and the motor is not rotated. In a clearing mode the cable is unspooled from around the wheel so that the cable pushes the head assembly along a length of the pipe and the motor spins the bit so that when the bit encounters a clog that clog is broken and flushed further along the length of the pipe.

In an alternate version the computer causes the motor to spin the bit only when the bit strikes a clog. In another version the computer is preprogrammed to extend the head assembly a maximum predetermined distance into the pipe. In yet another version the computer automatically controls a cycle from rest mode, through the clearing mode and back to the rest mode to clear a clog. In another version of the invention the head assembly includes a forward facing camera that is connected to the computer by the wire.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An automated pipe clearing device comprising a case assembly and a head assembly;

the case assembly contains a reel, a cable, a computer and a feeder;

the head assembly includes a motor;

the head assembly on a first end is connected to a first end of the cable;

the head assembly on a second end has a rotatable bit operatively connected to the motor;

a second end of the cable is in electrical communication with the computer;

the cable includes a wire to supply electrical power to the motor in the head assembly;

the feeder is controlled by the computer and selectively spools and unspools the cable from around the reel;

the case assembly is permanently mounted at a high side of a pipe;

the head assembly permanently remains inside the pipe;

in a rest mode the cable is spooled around the reel and the motor is not rotated;

in a clearing mode the cable is unspooled from around the wheel so that the cable pushes the head assembly along a length of the pipe and the motor spins the bit so that when the bit encounters a clog that clog is broken and flushed further along the length of the pipe.

2. An automated pipe clearing device as in claim 1 further characterized in that the computer causes the motor to spin the bit only when the bit strikes a clog.

3. An automated pipe clearing device as in claim 1 further characterized in that the computer is preprogrammed to extend the head assembly a maximum predetermined distance into the pipe.

4. An automated pipe clearing device as in claim 1 further characterized in that once initiated the computer automatically controls a cycle from rest mode, through the clearing mode and back to the rest mode to clear a clog.

5. An automated pipe clearing device as in claim 1 further characterized in that the head assembly includes a forward facing camera that is connected to the computer by the wire.

* * * * *